US006196202B1

(12) United States Patent
Busato et al.

(10) Patent No.: US 6,196,202 B1
(45) **Date of Patent: *Mar. 6, 2001**

(54) EVAPORATIVE EMISSION SYSTEM FOR LOW ENGINE INTAKE SYSTEM VACUUMS

(75) Inventors: Murray F. Busato; John Edward Cook, both of Chatham (CA)

(73) Assignee: Siemens Canada Limited, Mississauga (CA)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/107,518

(22) Filed: Jun. 30, 1998

Related U.S. Application Data

(60) Provisional application No. 60/053,940, filed on Jul. 28, 1997.

(51) Int. Cl.[7] ..... F02M 37/04

(52) U.S. Cl. ..... 123/520; 123/533; 123/198 D

(58) Field of Search ..... 123/520, 521, 123/519, 518, 516, 533, 198 D

(56) References Cited

U.S. PATENT DOCUMENTS

| | | | | |
|---|---|---|---|---|
| 5,054,454 | | 10/1991 | Hamburg | 123/520 |
| 5,080,078 | | 1/1992 | Hamburg | 123/521 |
| 5,146,902 | | 9/1992 | Cook et al. | 123/518 |
| 5,183,022 | * | 2/1993 | Cook | 123/516 |
| 5,273,020 | | 12/1993 | Hayami | 123/198 |
| 5,297,529 | | 3/1994 | Cook et al. | 123/520 |
| 5,375,578 | * | 12/1994 | Kato | 123/533 |
| 5,383,437 | | 1/1995 | Cook et al. | 123/520 |
| 5,411,004 | | 5/1995 | Busato et al. | 123/520 |
| 5,483,942 | | 1/1996 | Perry et al. | 123/520 |
| 5,511,529 | * | 4/1996 | Blumenstock | 123/516 |
| 5,829,416 | * | 11/1998 | Teraoka | 123/520 |
| 5,881,700 | * | 3/1999 | Gras | 123/520 |
| 5,890,474 | * | 4/1999 | Schnaibel | 123/520 |

FOREIGN PATENT DOCUMENTS

| | | |
|---|---|---|
| 25 47 065 | 9/1977 | (DE) . |
| 39 35 612 | 5/1990 | (DE) . |
| 43 16 392 | 2/1993 | (DE) . |
| 196 17 386 | 7/1997 | (DE) . |
| 08 40 002 | 6/1998 | (EP) . |
| 196 50 517 | 6/1998 | (DE) . |
| WO 97 47 874 | 12/1997 | (WO) . |

* cited by examiner

*Primary Examiner*—Carl S. Miller

(57) ABSTRACT

An evaporative emission control system for a fuel system of an internal combustion engine of an automotive vehicle has a purge flow path through which an evaporative emission containment space of the fuel system for containing volatile fuel vapors is purged to an intake system of the engine. A purge valve controls purge flow through the purge flow path. When the intensity of intake system vacuum falls below a threshold, an electric-motor-driven blower operates to creates a pressure rise in the purge flow path upstream of the purge valve and downstream of the containment space. A differential pressure sensor senses pressure differential across the purge valve, and the purge valve includes an integral valve position sensor, both sensors providing feedback signals to a controller than controls operation of both the purge valve and the blower.

5 Claims, 2 Drawing Sheets

EVAPORATIVE EMISSION SYSTEM FOR LOW ENGINE INTAKE SYSTEM VACUUMS

REFERENCE TO RELATED APPLICATIONS AND PRIORITY CLAIM

This application expressly claims the benefit of earlier filing date and right of priority from the following patent application: U.S. Provisional Application Ser. No. 60/053,940 filed on Jul. 28, 1997 in the names of Cook et al and entitled "Evaporative Emission System". The entirety of that earlier-filed, co-pending patent application is hereby expressly incorporated herein by reference.

The contents of commonly owned co-pending Non-provisional U.S. patent application Ser. No. 08/824,938, filed Mar. 26, 1997 in the names of Cook et al and entitled "Evaporative Emission Leak Detection System", and the contents of commonly-owned U.S. Pat. No. 5,551,406 are hereby incorporated in their entirety by reference as if fully disclosed herein.

FIELD OF THE INVENTION

This invention relates generally to an evaporative emission control system of an automotive vehicle fuel system, and more especially to an evaporative emission control system that does not depend exclusively on engine intake system vacuum for purging fuel vapors to an engine.

BACKGROUND OF THE INVENTION

A known evaporative emission control system for a fuel system of an internal combustion engine that powers an automotive vehicle comprises an evaporative emission containment space for containing volatile fuel vapors and a purge valve through which the fuel vapors are purged from the evaporative emission containment space to an intake system of the engine for combustion. The evaporative emission containment space includes headspace of a fuel tank that contains a supply of volatile liquid fuel for the engine and an associated fuel vapor collection canister, e.g. a charcoal canister, through which the tank headspace is vented to atmosphere.

The purge valve opens when conditions are conducive to purging, commnicating the evaporative emission containment space to the engine intake system. Atmospheric venting of the tank headspace maintains the tank headspace pressure near atmospheric. Intake system vacuum communicated through the open purge valve draws gases present in the evaporative emission containment space (a mixture of fuel vapors and air) through the purge valve and into the intake system. There the purge flow entrains with intake flow into the engine, ultimately to be disposed of by combustion within the engine. A known purge valve comprises an electric actuator that receives a control signal developed by an engine management computer to open the purge valve in the proper amount for various operating conditions, thereby developing the desired purge flow.

Because the evaporative emission control system relies solely on intake system vacuum to draw fuel vapors from the evaporative emission containment space, the intensity of the vacuum directly effects the purge flow rate. At larger vacuum intensities, the engine management computer can adjust the purge valve to compensate for changes in vacuum. However, when system vacuum falls below a certain threshold that is determined by various factors, there is insufficient pressure differential between the evaporative emission containment space and the intake system to develop the requisite purge flow.

Some automotive vehicle internal combustion engines may develop nominal intake system vacuums that range from about 10 inches Hg to about 20 inches Hg. Purge valves used with such engines are designed for such a range. For any one or more of various reasons however, actual intake system vacuum in a particular engine may be incapable of exhibiting that nominal range. That characteristic may impair operation of an evaporative emission control system because there is insufficient pressure differential to develop the desired purge flows. An engine that has direct high-pressure gasoline fuel injection may exhibit a nominal system vacuum range that is much closer to atmospheric pressure than the nominal range of intake system vacuum for other engines.

SUMMARY OF THE INVENTION

The present invention relates to an evaporative emission control system which can develop requisite vapor purge flow even when intake system vacuum falls below a threshold at which the pressure differential between the evaporative emission containment space and the intake system becomes insufficient to attain the requisite purge flow. Accordingly, the invention provides an evaporative emission control system that can develop the proper purge flow independent of prevailing engine intake system vacuum.

One general aspect of the invention relates to an evaporative emission control system for an evaporative emission containment space of a fuel system of an internal combustion engine of an automotive vehicle, the evaporative emission control system comprising: a purge flow path through which fuel vapors are purged from the containment space to an intake system of the internal combustion engine; a purge valve for controlling purge flow through the purge flow path; and an electrically controlled device that is responsive to a condition associated with purging of the containment space to the engine intake system through the purge valve for creating a condition that augments the purge flow controlled by the purge valve.

Some of the more specific aspects that characterize the invention include: the device creating, in the purge flow path between the evaporative emission containment space and the purge valve, a pressure rise that augments purge flow controlled by the purge valve; the device having an inlet for communication to the evaporative emission containment space and an outlet communicated to the purge valve; including a canister comprising a fuel vapor zone for communication to the containment space, an atmospheric zone for communication to atmosphere, and a fuel vapor adsorbent medium that separates the two zones from each other; the device being disposed to create the pressure rise in the purge flow path between the canister and the purge valve; the device; the device comprising an electric-controlled prime mover, such as an electric-motor-driven blower, that is selectively operable to a pressure-creating condition for augmenting the purge flow through the purge valve and to a non-pressure-creating condition that allows bi-directional flow through the purge flow path; the condition to which the electrically controlled device is responsive being pressure differential across the purge valve as sensed by a differential pressure sensor; an electric controller for processing input data, such as the differential pressure sensor signal to control operation of both the device and the purge valve; and the purge valve including a sensor providing a feedback signal to the controller indicative of actual operation of the purge valve mechanism.

Another general aspect of the invention relates to an automotive vehicle comprising: an internal combustion engine for powering the vehicle; a tank for holding a supply of volatile fuel for the engine; and an evaporative emission control system for containing and disposing of fuel vapors resulting from the volatilization of fuel in the tank, the evaporative emission control system comprising a purge flow path through which contained fuel vapors are purged to the engine for disposal, a purge valve for controlling purge flow through the purge flow path, and a purge flow path through which fuel vapors are purged from the containment space to an intake system of the internal combustion engine; and an electrically controlled device that is responsive to a condition associated with purging of the containment space to the engine intake system through the purge valve for creating a condition that augments the purge flow controlled by the purge valve.

Still another general aspect of the invention relates to a method of enabling a purge valve to accurately control the purging of volatile fuel vapors through a purge flow path extending from an evaporative emission containment space, through the purge valve, to an intake system of an internal combustion engine, the method comprising: operating an electrically controlled device in response to a condition associated with purging of the containment space to the engine intake system through the purge valve to create a condition that augments the purge flow controlled by the purge valve.

More specific aspects of the method include: creating pressure differential to augment the purge flow controlled by the purge valve; sensing pressure differential across the purge valve and utilizing the sensed pressure differential in control of at least one of the purge valve and the device; and sensing the extent to which the purge valve is actually open and utilizing the result in control of at least one of the purge valve and the device.

BRIEF DESCRIPTION OF THE DRAWINGS

The accompanying drawings, which are incorporated herein and constitute part of this specification, include one or more presently preferred embodiments of the invention, and together with a general description given above and a detailed description given below, serve to disclose principles of the invention in accordance with a best mode contemplated for carrying out the invention.

DESCRIPTION OF THE PREFERRED EMBODIMENT

Figure 1:
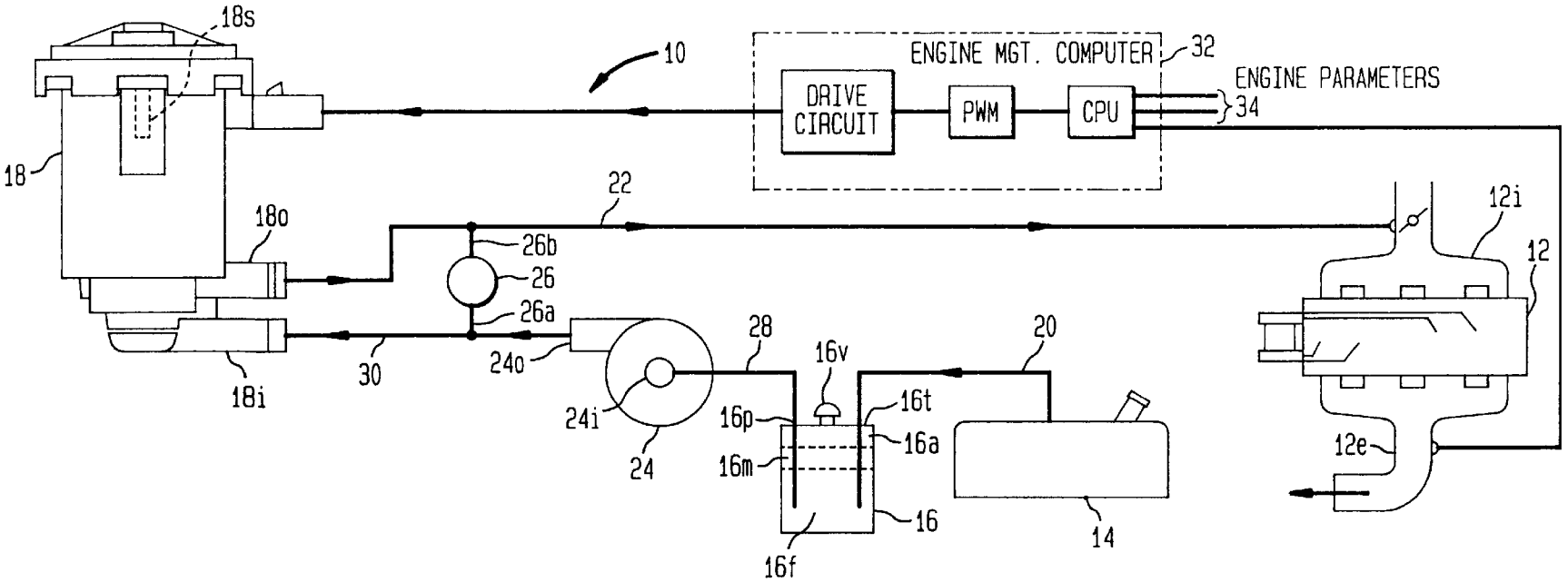
FIG. 1 is a general schematic diagram of an exemplary automotive vehicle evaporative emission control system embodying principles of the invention.

FIG. 1 shows an exemplary evaporative emission control system 10 embodying principles of the invention in association with an internal combustion engine 12 that powers an automotive vehicle. Engine 12 comprises an intake system 12*i* of the type having an intake manifold and an exhaust system 12*e* of the type having an exhaust manifold. A fuel system for engine 12 includes a fuel tank 14 for holding a supply of volatile liquid fuel.

Evaporative emission control system 10 includes a vapor collection canister 16 (charcoal canister) and a purge valve 18. The particular configuration illustrated for canister 16 comprises a tank port 16*t*, an atmospheric vent port 16*v*, and a purge port 16*p*. Within canister 16 is a vapor adsorbent medium 16*m* that divides the canister interior into a fuel vapor zone 16*f* and a clean air zone 16*a*. Medium 16*m* forms a fuel vapor barrier between port 16*v* on the one hand and ports 16*p* and 16*t* on the other hand. Air, but not fuel vapors, can transpass through medium 16*m*.

Purge valve 18 comprises an inlet port 18*i*, an outlet port 18*o*, and an valve mechanism between the two ports. A purge valve like the one described in the above-referenced U.S. Pat. No. 5,551,406 is suitable for purge valve 18. The purge valve is a linear solenoid actuated valve that includes an integral sensor 18*s* for sensing actual position of the valve mechanism to signal the extent to which the valve is open.

Headspace of fuel tank 14 is communicated to tank port 16*t* of canister 16 by a conduit 20. Another conduit 22 communicates outlet port 18*o* to engine intake system 12*i*. The conduits and passages that form a purge flow path may have nominal diameters that are somewhat larger than if system 10 were to rely exclusively on intake system vacuum to induce the purge flow. It is believed that a nominal 12 mm. diameter is suitable for certain engines.

Figure 2:
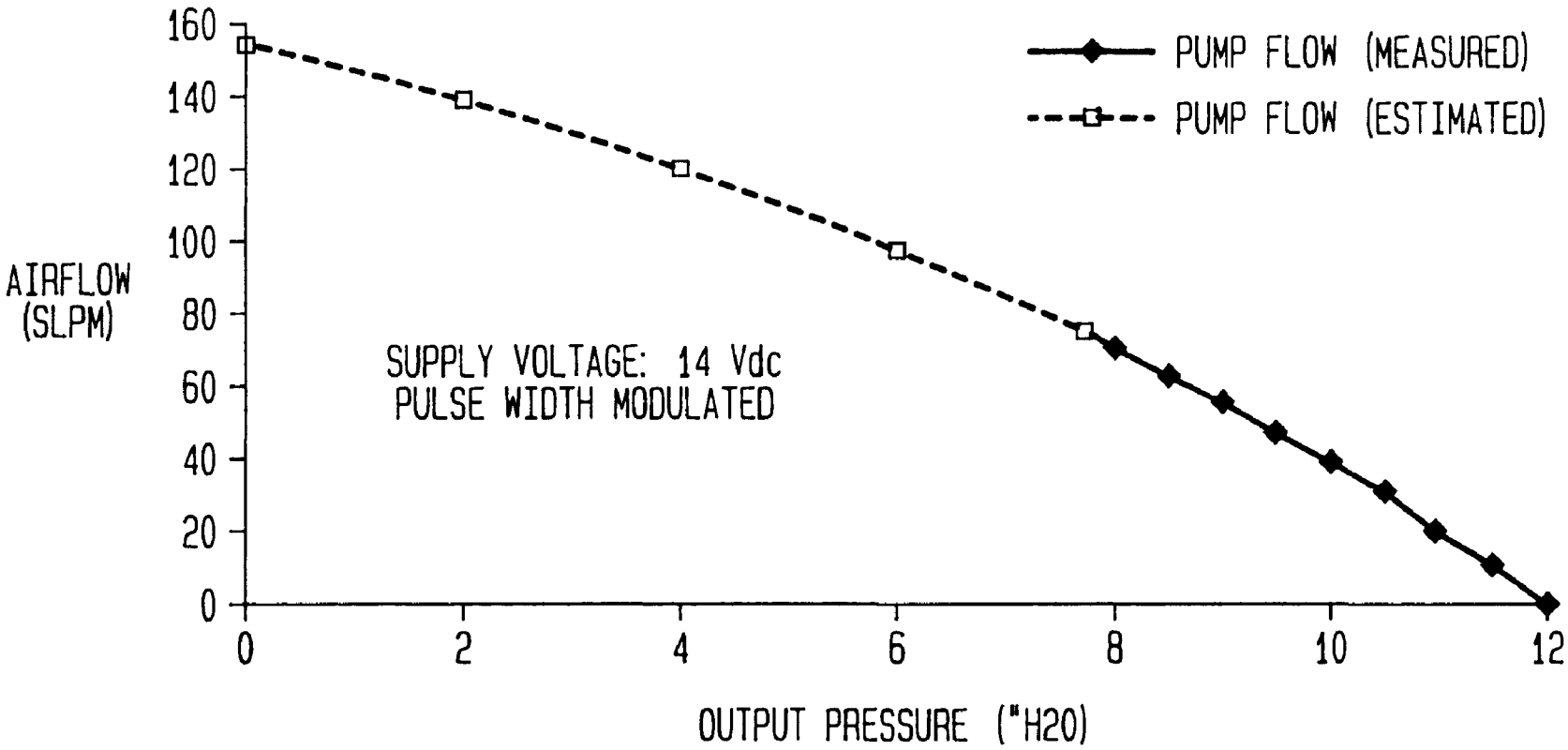
FIG. 2 is an exemplary graph plot useful in explaining certain principles.

In accordance with principles of the invention, evaporative emission control system 10 further includes an electric motor driven centrifugal blower 24 and a differential pressure sensor 26. Blower 24 comprises an inlet 24*i* and an outlet 24*o*. Sensor 26 comprises a differential pressure sensing input comprising a first sensing port 26*a* communicated to inlet port 18*i* and a second sensing port 26*b* communicated to outlet port 18*o*, thereby enabling the sensor to sense the actual pressure differential across the valve mechanism. A conduit 28 communicates canister purge port 16*p* to blower inlet port 24*i*, and a conduit 30 communicates blower outlet port 24*o* to purge valve inlet port 18*i*. Blower 24 can be a device like the electric-motor-driven centrifugal impeller described in the above-referenced Non-provisional U.S. patent application Ser. No. 08/824,938. FIG. 2 shows a characteristic graph plot for that blower. It is believed that other single- or multiple-stage devices can also be used in general, a minimum specification for such a device is believed to be the ability to efficiently develop about 25 millibar pressure for a given mass flow.

An engine management computer (EMC) 32 receives various data inputs 34 relevant to control of certain functions associated with operation of engine 12. One of the tasks of EMC 32 is to control the operation of purge valve 18. EMC 32 comprises a central processing unit (CPU) that is programmed with algorithms for processing selected data parameters relevant to control of purge valve 18 to develop a purge control signal. This signal is converted to a pulse width modulated signal by circuit PWM, and the latter signal's power level is boosted by a drive circuit that delivers the boosted signal to an electric actuator of purge valve 18. During conditions conducive to purging, fuel vapors present in an evaporative emission containment space that is cooperatively defined primarily by the headspace of tank 14 and canister 16 are purged to engine intake system 12*i* through a purge flow path that comprises conduit 28, blower 24, conduit 30, purge valve 18, and conduit 22. While such a controller for system 10 utilizes sharing of the engine management computer, it is contemplated that a devoted controller could be employed if desired.

When conditions are conducive to purging, the existence of a sufficient intensity of intake system vacuum will allow system 10 to function without operating blower 24. Sensors 18*s* and 26 supply respective signals as feedback to EMC 32. EMC 32 processes these signals, and others, in exercising control over purge valve 18. Blower 24, when idle, provides an essentially unrestricted bi-directional flow path and therefore has essentially no effect on the purge flow.

Should intake system vacuum drop below a certain threshold, that may be sensed by EMC 32 from one or both of the feedback signals, EMC 32 then operates blower 24 by causing electric D.C. current to be delivered to the blower motor. Blower 24 now operates to create a pressure rise in the purge flow path between the evaporative emission containment space and purge valve 18. The blower operates at speeds commanded by EMC 32 to develop desired pressure differential across purge valve 18. Operation of purge valve 18 is coordinated with operation of blower 24 to yield the desired purge flow for prevailing operating conditions. As conditions change, EMC 34 may make suitable adjustments in operation of one or both of purge valve 18 and blower 24. For a given extent of opening of purge valve 18, purge flow is a function of pressure differential across the valve. Changes in intake system vacuum may be compensated for by changing the operating speed of blower 24 thereby changing the boost pressure developed by the blower.

It is contemplated that the inventive principles may be practiced in configurations other than the one specifically shown in FIG. 1. Rather than blower 24 being disposed between the evaporative emission containment space and the purge valve, its outlet may communicated to canister vent port 16*v*. Fuel vapor would therefore not have to pass through it. Rather than having a devoted device for blower 24, a pre-existing device on a vehicle may be used. Such a device could be a secondary air pump or an evaporative emission leak detection pump.

It is to be understood that because the invention may be practiced in various forms within the scope of the appended claims, certain specific words and phrases that may be used to describe a particular exemplary embodiment of the invention are not intended to necessarily limit the scope of the invention solely on account of such use.

What is claimed is:

1. An evaporative emission control system for an evaporative emission containment space fuel system of an internal combustion engine of an automotive vehicle, the evaporative emission control system comprising:

a purge flow path through which fuel vapors are purged from the containment space to an intake system of the internal combustion engine;

a purge valve for controlling purge flow through the purge flow path; and an electric-controlled device that is responsive to pressure differential across the purge valve for augmenting the purge flow controlled by the purge valve;

the device comprising an electric-controlled prime mover that is selectively operable to a pressure-creating condition for augmenting the purge flow through the purge valve and to a non-pressure-creating condition that allows bi-directional flow through the purge flow path;

the electric-controlled prime mover comprising an electric-motor-driven blower disposed in the purge flow path between the evaporative emission containment space and the purge valve; and a differential pressure sensor having an input for sensing pressure differential across the purge valve, as measured between an inlet port at which purge flow enters the purge valve and an outlet port at which purge flow exits the purge valve and to which intake system vacuum is communicated, and an output for providing a corresponding electric signal to an electric circuit that controls the device and that is responsive to change in the electric signal caused by decrease in intake system vacuum to cause the device to augment the purge flow to compensate for the decrease in intake system vacuum.

2. An evaporative emission control system for an evaporative emission containment space of a fuel system of an internal combustion engine of an automotive vehicle, the evaporative emission control system comprising:

a purge flow path through which fuel vapors are purged from the containment space to an intake system of the internal combustion engine;

a purge valve for controlling purge flow through the purge flow path; and an electric-controlled device that is responsive to pressure differential across the purge valve for augmenting the purge flow controlled by the purge valve; and a differential pressure sensor having an input for sensing pressure differential across the purge valve, as measured between an inlet port at which purge flow enters the purge valve and an outlet port at which purge flow exits the purge valve and to which intake system vacuum is communicated, and an output for providing a corresponding electric signal to an electric controller that controls the device and that is responsive to change in the electric signal caused by decrease in intake system vacuum to cause the device to augment the purge flow to compensate for the decrease in intake system vacuum.

3. An evaporative emission control system for an evaporative emission containment space of a fuel system of an internal combustion engine of an automotive vehicle, the evaporative emission control system comprising:

a purge flow path through which fuel vapors are purged from the containment space to an intake system of the internal combustion engine;

a purge valve for controlling purge flow through the purge flow path, the purge valve having an inlet port at which the purge flow enters the purge valve and an outlet port at which purge flow exits the purge valve and to which intake system vacuum is communicated; and an electric-controlled device that is responsive to pressure differential across the purge valve for augmenting the purge flow controlled by the purge valve;

an electric controller for processing input data to control operation of both the device and the purge valve;

the purge valve comprising an electric actuator that is controlled by the controller to operate a purge valve mechanism of the purge valve for controlling purge flow, and the device comprising an electric-controlled prime mover that is controlled by the controller; and including a sensor providing a feedback signal to the controller indicative of actual pressure differential across the purge valve mechanism;

the electric controller being responsive to change in the feedback signal caused by decrease in intake, system vacuum to cause the electric-controlled prime mover to augment the purge flow to compensate for the decrease in intake system vacuum.

4. An evaporative emission control system as set forth in claim 3 in which the purge valve includes a sensor providing a feedback signal to the controller indicative of actual operation of the purge valve mechanism.

5. An automotive vehicle comprising:

an internal combustion engine for powering the vehicle;

a fuel system comprising a tank for holding a supply of volatile fuel for the engine and a containment space for containing fuel vapors; and an evaporative emission control system for containing and disposing of fuel vapors resulting from the volatilization of fuel in the tank, the evaporative emission control system comprising:

a purge flow path through which contained fuel vapors are purged to the engine for disposal;

a purge valve for controlling purge flow through the purge flow path, an electric-controlled device that is responsive to a condition associated with purging of the containment space to the engine through the purge valve for augmenting the purge flow controlled by the purge valve;

an electric controller for controlling operation of the purge valve and of the device by respective control signals; and including a first sensor providing a feedback signal to the controller indicative of actual operation of the purge valve and a second sensor providing a feedback signal to the controller indicative of actual pressure differential across the purge valve, as measured between an inlet port at which purge flow enters the purge valve and an outlet port at which purge flow exits the purge valve and to which intake system vacuum is communicated; and the electric controller being responsive to change in the feedback signal from the second sensor caused by decrease in intake system vacuum to cause the electric-controlled device to augment the purge flow to compensate for the decrease in intake system vacuum.

* * * * *